US006418285B1

(12) United States Patent
Casella et al.

(10) Patent No.: US 6,418,285 B1
(45) **Date of Patent: *Jul. 9, 2002**

(54) BOB CLEANERS TO CONTROL AND MAINTAIN PR MODULE MOTION QUALITY LATITUDE

(75) Inventors: James M. Casella, Webster; Nero R. Lindblad, Ontario; James C. Diehl, Webster, all of NY (US); Rene Sanchez, Berkley, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,753

(22) Filed: Oct. 27, 2000

(51) Int. Cl.[7] ..... G03G 21/00

(52) U.S. Cl. ..... 399/162; 399/350; 399/352

(58) Field of Search ..... 399/162–165, 399/343, 345, 350, 352–354; 15/256.5–256.52

(56) References Cited

U.S. PATENT DOCUMENTS

| | | | | |
|---|---|---|---|---|
| 5,655,205 A | * | 8/1997 | Ziegelmuller et al. | 399/350 |
| 6,253,056 B1 | * | 6/2001 | Lindblad et al. | 399/352 |
| 6,259,882 B1 | * | 7/2001 | Lindblad et al. | 399/352 |
| 6,292,637 B1 | * | 9/2001 | Lindblad et al. | 399/350 X |

* cited by examiner

*Primary Examiner*—William J. Royer
(74) *Attorney, Agent, or Firm*—Lloyd F. Bean, II

(57) ABSTRACT

An apparatus for controlling velocity variations in a belt wrapped about at least a first driven roller and a support structure, including a drive for driving the first driven roller so as to provide torque to the belt; and a dampener, in contact with the belt, for minimizing variations of the velocity of the belt, the dampener including a power supply for applying an electrical bias to generate a drag force on the belt.

6 Claims, 7 Drawing Sheets

BOB CLEANERS TO CONTROL AND MAINTAIN PR MODULE MOTION QUALITY LATITUDE

BACKGROUND OF THE INVENTION

This invention relates generally to an electrostatographic printer or copier, and more particularly concerns a method for maintaining motion quality latitude employing a device for cleaning the backside of a photoreceptor belt.

In an electrophotographic application such as xerography, a charge retentive surface (i.e., photoconductor, photoreceptor or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. Contacting it with a finely divided, electrostatically attractable powder referred to as "toner" develops the latent image. Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is well known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

One type of charge retentive surface typically utilized in the electrostatographic reproduction device is a photoreceptor belt having a base of flexible material. The photoreceptor belt is entrained about a plurality of support rollers so as to form a closed loop path. The photoreceptor belt is driven about the closed loop path to present particular areas of the photoreceptor belt sequentially into association with electrographic process stations to form desired reproductions. Adhered to the backside of the photoreceptor belt is a substrate polycarbonate known as anti-curl back coating. The purpose of this coating is to balance the stresses within the photoreceptor belt and control edge curling. Over time as a photoreceptor belt repeatedly travels around the sharp corners of rollers, backer bars, and other surfaces, the anti-curl back coating begins to wear and flake off in the form of low charged negative particles. As a result, a build up of anti-curl back coating particles occurs on all parts of the module which come in contact with the anti-curl back layer. Additionally, toner particles from the development system, the imaging surface cleaner, and toner airborne in the xerographic module are deposited on the back of the belt. In particular, there is a buildup of anti-curl back coating particles and toner particles on the drive roller, the backer bars, and in the Acoustic Transfer Assist (ATA) device.

Debris particles on the drive roller cause the coefficient of friction of the drive roller to drop appreciably. This buildup of particles on the backside of the photoreceptor belt and drive roller may adversely affect performance of the photoreceptor belt as it is driven about the closed loop path and, ultimately, overall performance of the reproduction apparatus.

A failure mode associated with low drag of the photoreceptor belt. The low drag, which reduces the total contact ratio between the adjoining gear teeth in the drive, substantially decreases the drive stiffness between the drive roller and motor altering the overall drive dynamics of the belt module. The change in drive dynamics renders the existing motor compensation useless, significantly degrading the motion quality latitude of the belt.

SUMMARY OF THE INVENTION

Briefly stated, and in accordance with one aspect of the present invention, there is provided an apparatus for removing electrostatically charged particles from a surface.

In accordance with another aspect of the present invention, there is provided an apparatus for controlling velocity variations in a belt wrapped about at least a first driven roller and a support structure, including a drive for driving said first driven roller so as to provide torque to the belt; and a dampener, in contact with said belt, for minimizing variations of the velocity of the belt, said dampener including a power supply for applying an electrical bias to generate a drag force on the belt.

BRIEF DESCRIPTION OF THE DRAWINGS

The foregoing and other features of the instant invention will be apparent and easily understood from a further reading of the specification, claims and by reference to the accompanying drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

Figure 1:
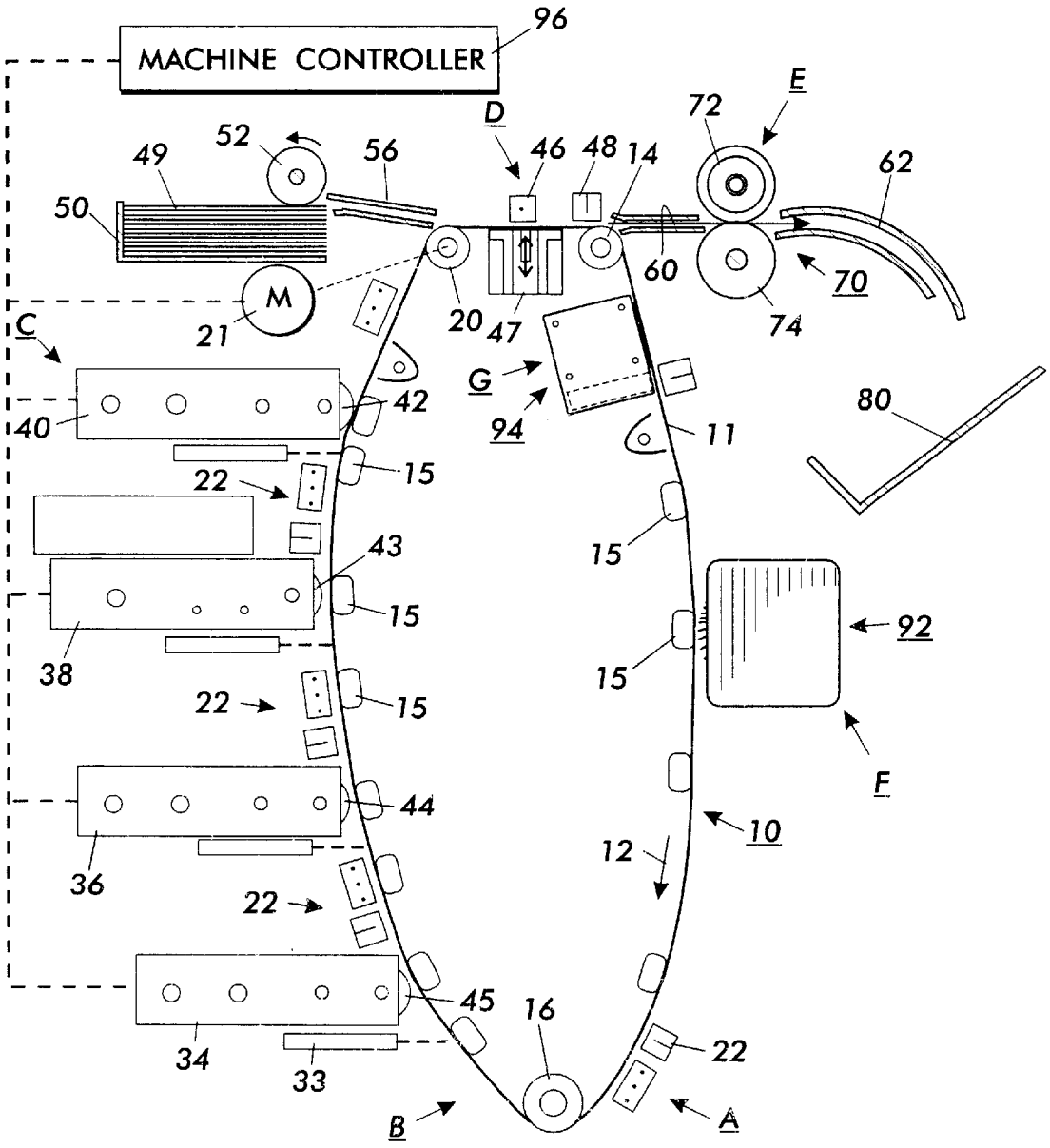
FIG. 1 is a schematic illustration of a printing apparatus incorporating the inventive features of the present invention.

For a general understanding of an electrophotographic printer or copier, in which the present invention may be incorporated, reference is made to FIG. 1, which depicts schematically the various components thereof. Hereinafter, like reference numerals have been used through out to identify identical elements. Although the brush belt cleaner apparatus of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, a drive roller 20, and backer bars indicated generally as 15. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative. At exposure station B, a Raster Output Scanner (ROS) 33 exposes the charged portions of photoreceptor belt 10 to record an electrostatic latent image thereon.

Thereafter, the belt 10 advances the electrostatic latent image to development station C. At development station C, a developer housing 34, 36, 38, or 40 is brought into contact with the belt 10 for the purpose of developing the electrostatic latent image. Each developer housing 34, 36, 38, and 40 supports a developing system such as magnetic brush rolls 42, 43, 44, and 45, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. Acoustic Transfer Assist device 47 provides vibrational energy to photoreceptor belt 10 at a frequency sufficient to assist in loosening the toner powder image and thereby facilitating transfer of the image to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the image side of photoreceptor belt 10 after each copy is made, may be removed at cleaning station F, represented by the reference numeral 92. At cleaning station F residual toner particles are removed and may also be stored for disposal.

Residual particles, collecting on the backside of photoreceptor belt 10, may be removed at the back of belt cleaning station G. A cleaning apparatus of the present invention is represented by the reference numeral 94, which will be described in greater detail in FIGS. 2–4. Removed residual particles may also be stored for disposal.

A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic printing machine, which exemplifies one type of apparatus employing the present invention therein.

Figure 2:
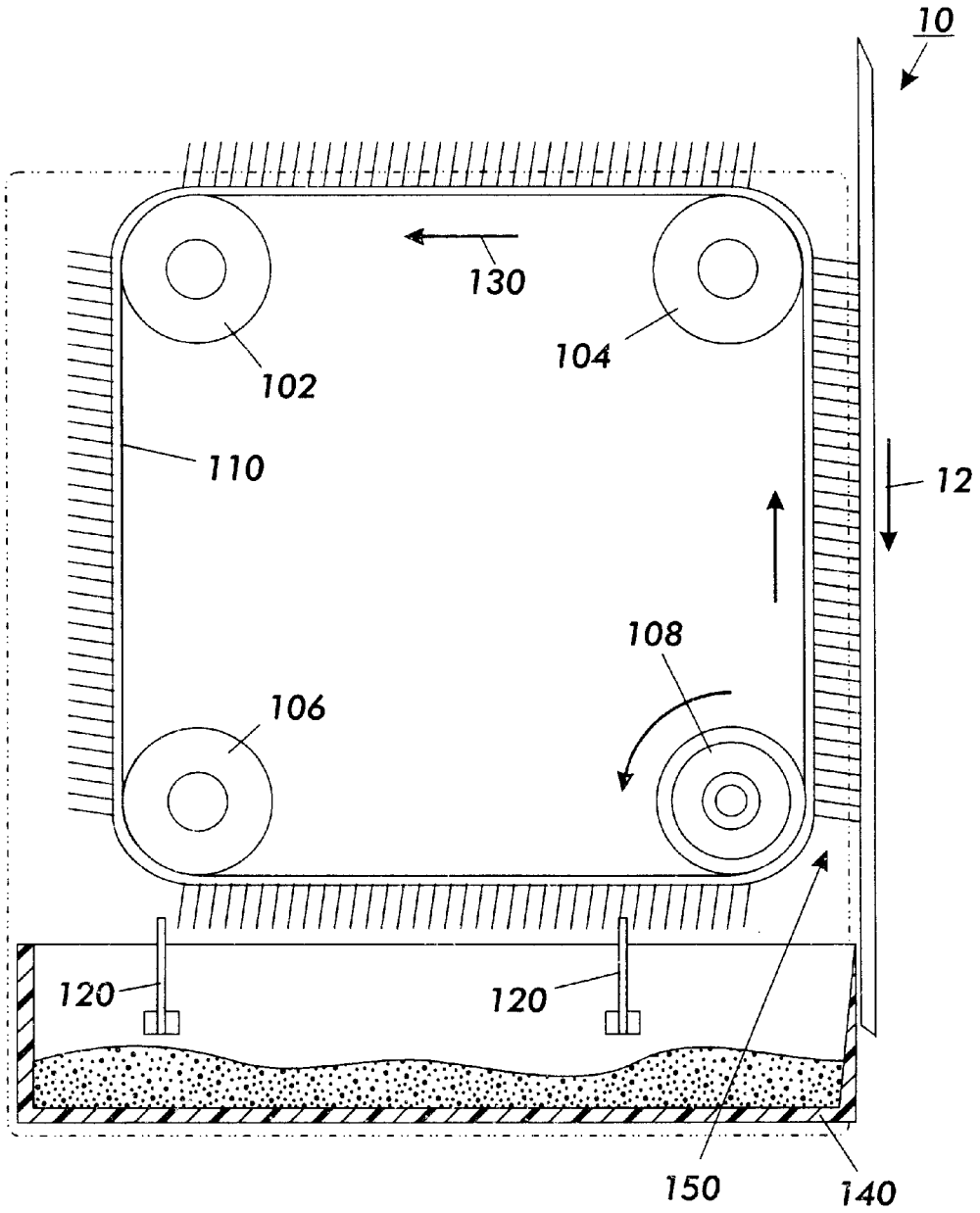
FIG. 2 is an elevational view of belt cleaning station.
Figure 3:
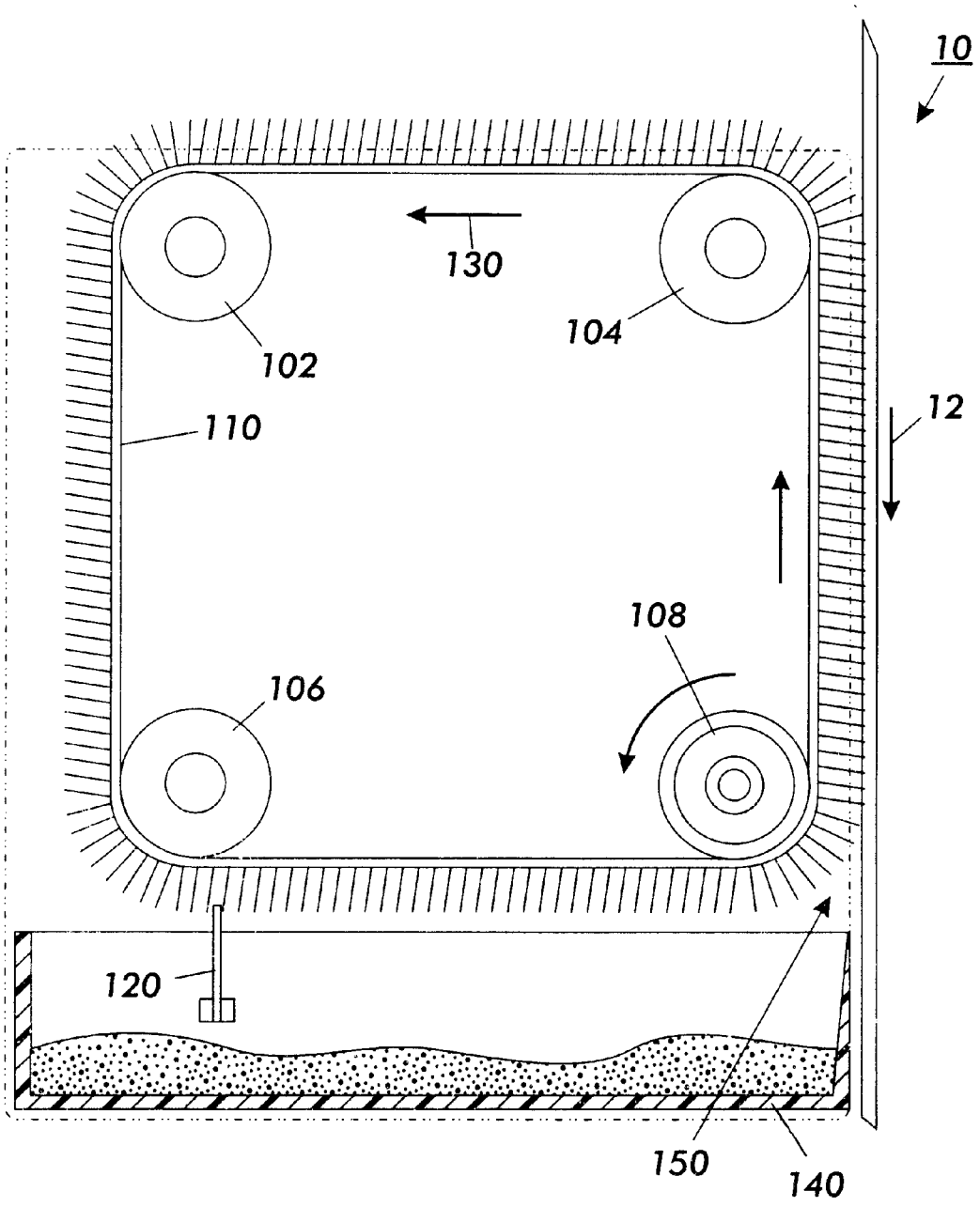
FIG. 3 is an elevational view of another embodiment of the belt cleaning station.
Figure 4:
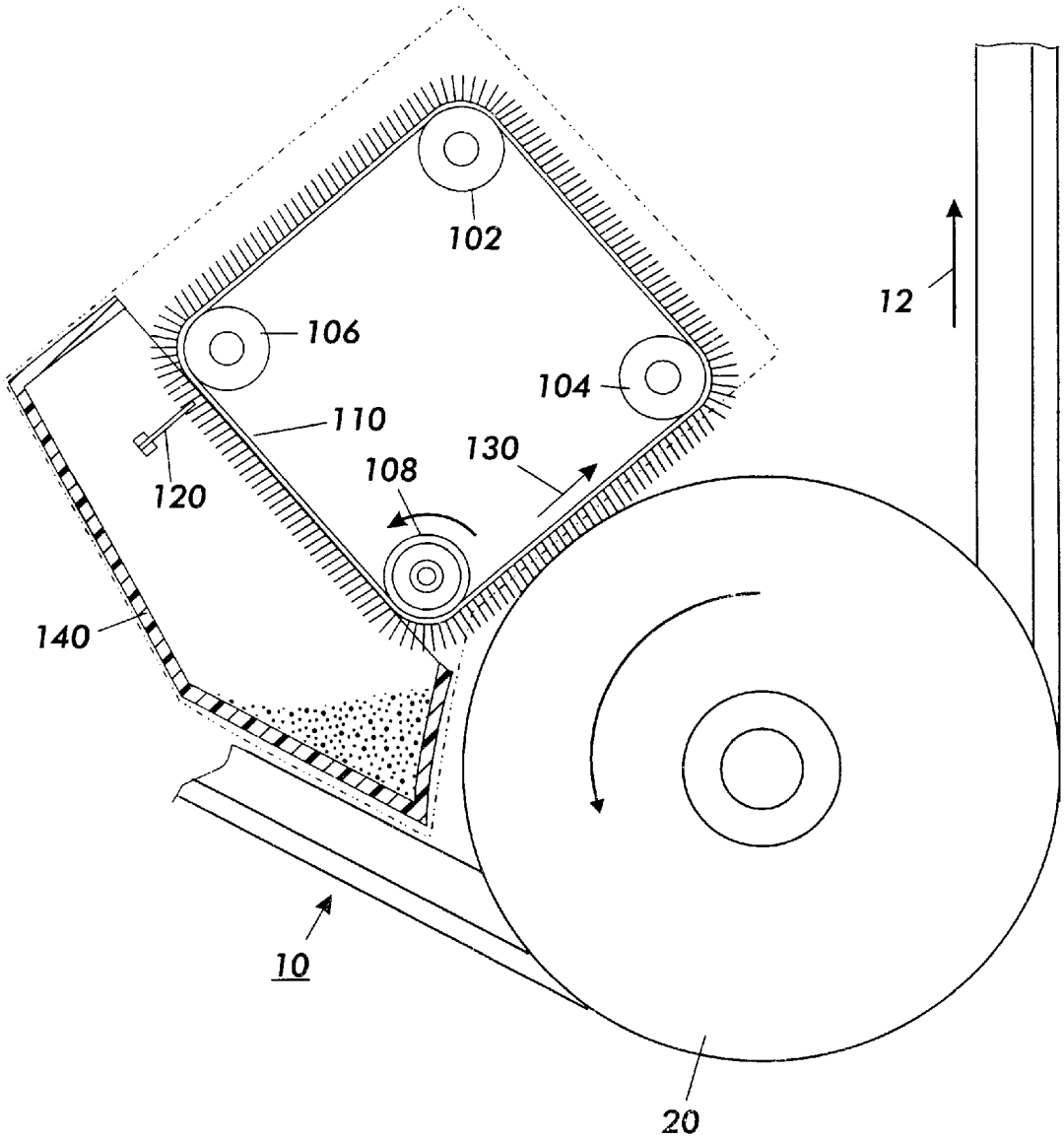
FIG. 4 is an elevational view of still another embodiment of the belt cleaning station.

Reference is now made to FIGS. 2–4, where debris accumulates on the back side of the photoreceptor belt and the drive roller as the result of movement of the photoreceptor belt over the backer bars and rollers supporting the photoreceptor belt. Adhesion of the debris to the back of the belt is low because there is a low triboelectric relationship between the particles and the back of the photoreceptor belt. Therefore, a minimal charge is developed as the particles rub against the backer bars and rollers supporting the photoreceptor belt. Removal of such debris adhered to the back side of a dielectric surface can be accomplished by mechanical, electrical or electromechanical means. The belt brush cleaner employs a combination of electrical and mechanical forces to detach and remove debris from the backside of the photoreceptor belt.

Reference is now made to FIG. 3, which shows an alternate embodiment of the belt cleaning station. As in the previous embodiment, the flexible belt brush 110 is shown in operable condition in contact with the backside of photoreceptor belt 10 through cleaning nip 150. Flexible belt brush 110 is electrically biased to suitable magnitude and polarity and is comprised of a continuous loop of conductive backing material (e.g. urethane, polycarbonate or polyester) to which conductive brush fibers are attached with conductive glue to form an endless brush belt. The flexible belt brush 110 is entrained about four rollers 102, 104, 106, and 108, one of which is a drive roller, and moving in direction 130 opposed to the movement of photoreceptor belt 10. The two rollers 104 and 108 support the belt brush 110 in brushing contact with photoreceptor belt 10. The third and fourth rollers 106 and 108 support belt brush 110 as the conductive brush fibers are brought into contact with flicker bar 120, which engages the fibers of the brush belt as the fibers move past the flicker bar. As the fibers rebound from contact with the flicker bar 120, the fibers release debris particles, which fall into waste chamber 140. Coupled to the drive roller is a drive means, which continuously rotates the drive roller to move the belt brush in direction 130. Although entraining the belt brush about four rollers is suitable for many applications, it is understood that some applications may require an alternate number of support rollers.

Figure 5:
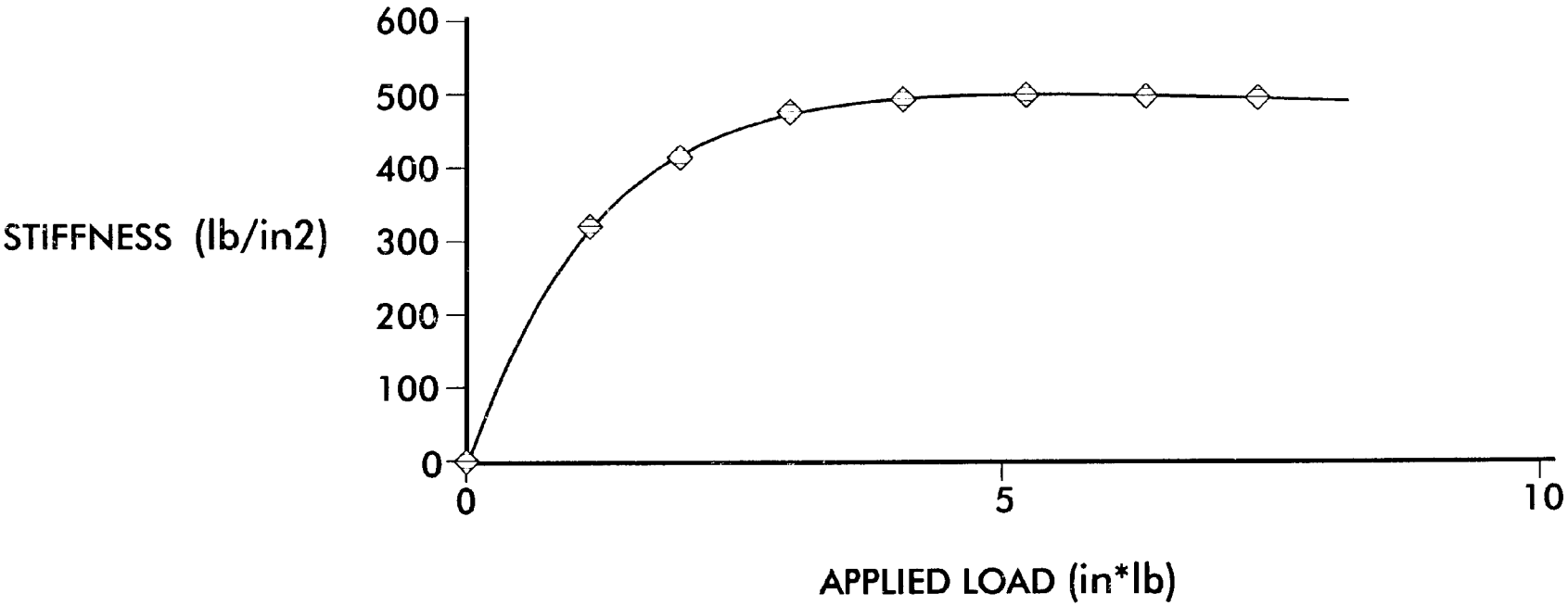
FIG. 5 is a graph illustrating drive stiffness as a function of applied torque.

Applicants have found that when the surface drag of the belt module becomes too low, the resulting torque transmitted by the drive roller is substantially reduced. As the drive torque decreases, the line contact that is typical between adjoining gear teeth in the drive begins to approach point contact along the lead direction of the tooth. The length of gear contact, otherwise known as contact ratio, is a key contributor to the stiffness of the motor drive. When the gear teeth approach point contact, the drive stiffness between the motor and drive roller is significantly reduced. The change in drive stiffness due to low surface drag is illustrated in FIG. 5.

As drive stiffness between the motor and drive roller drops, the drive dynamics of the overall belt module changes. The change in drive dynamics renders the existing motor compensation useless, where poles and zero's in the compensation become mis-aligned with the first mechanical resonance, significantly degrading the motion quality latitude of the belt. This problem is descriptive of the recent failure mode where a PWM drop from 80% to 60% due to lower drag is causing large motion quality errors at the motor ripple frequencies at the belt surface.

In the above example, a minimum torque load of roughly 3 lbs is required in the belt module gear drive to maintain the drive stiffness to a near constant level. If the torque load decreases due to a reduction in surface drag, the gear drive stiffness also decreases. Applicants have found using gear modeling software, in which the total contact ratio between adjoining gear teeth decreases when some level of gear misalignment is present. The equation for a simple first order linear system below shows that such a stiffness change, keeping the mass of the system constant, will cause a reduction in first mechanical resonance, $F_n$, of a system.

$$F_{n=1/2\pi^{*}sqr(K/M)}$$

The present invention employs classical controls and a sensor can be added to the existing Back of Belt Cleaning devices to close the loop around the motor PWM signal. A block diagram of the automated BOBC's in closed loop control is illustrated in FIG. 6.

Figure 6:
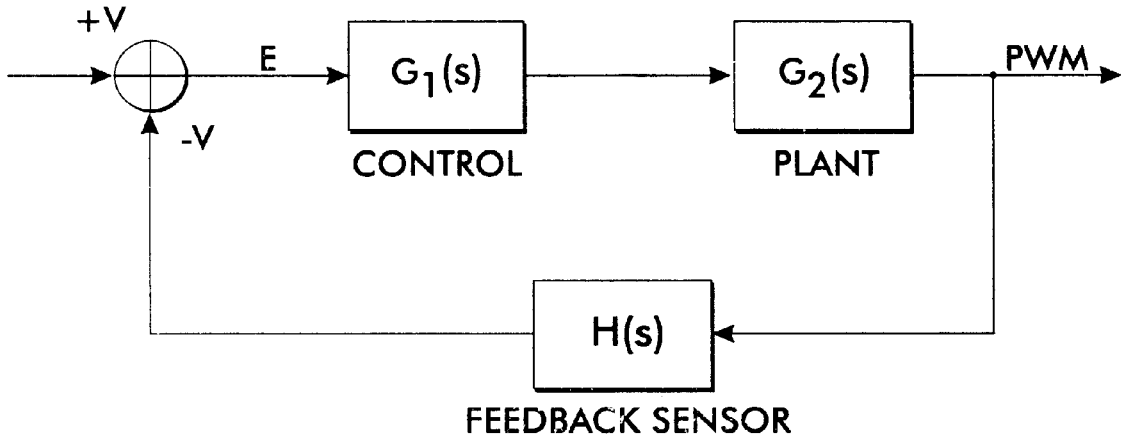
FIG. 6 is a closed loop block diagram of the controller of the present invention.

In FIG. 6, the initial motor PWM is converted to an analog signal, H(s). This signal is subtracted from the reference voltage, +V, in which an error voltage, E is generated. The error signal is used by the controller, G1 (s), to generate a plant output at G2(s). The plant will then adjust the charge on the back surface of the belt to ultimately converge a low motor PWM signal, say 60%, to a stable reference condition, say 80 to 85%.

Figure 7:
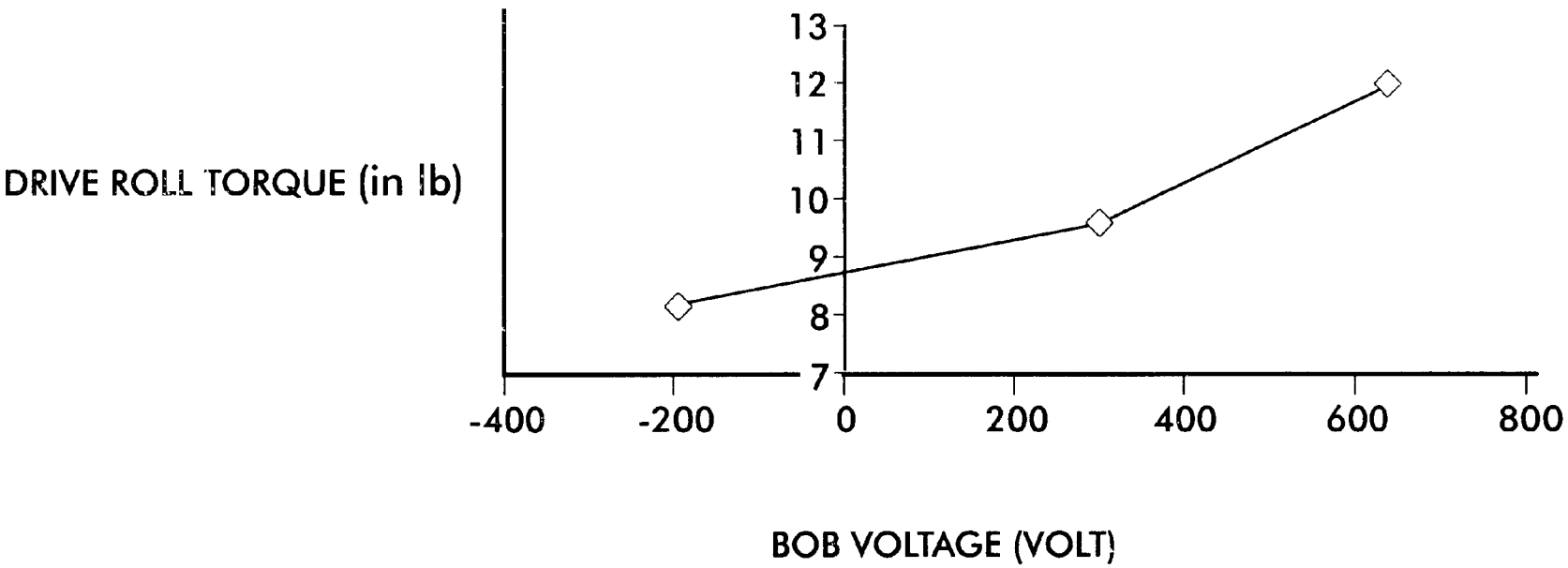
FIG. 7 is a graph illustrating drive motor torque versus BOB input voltage.

The ability of the present invention to control drive torque is illustrated in FIG. 7. FIG. 7 illustrates test data employing the principles of the present invention. The graph shows that as the BOB voltage is independently varied, the charge on the back surface changes which changes the drag force across each of the backer bars (item 15 of FIG. 1) which ultimately controls the drive roll torque going to the photoreceptor motor. A positive change in BOB voltage increases drive roller torque while a negative change in BOB voltage decreases drive roller torque.

It is therefore apparent that there has been provided, in accordance with the present invention an apparatus for maintaining motion quality latitude employing a device for cleaning the backside of a photoreceptor belt that fully satisfies the aims and advantages set forth hereinabove. While this invention has been described in conjunction with specific embodiments thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed:

1. An apparatus for controlling velocity variations in a belt wrapped about at least a first driven roller and a support structure, comprising:

means for driving said at least first driven roller so as to provide torque to the belt; and dampening means, in contact with said belt, for minimizing variations of the velocity of the belt, said dampening means including means for applying an electrical bias to generate a drag force on the belt.

2. The apparatus according to claim 1 wherein, said dampening means includes a device for cleaning particles from a non-imaging surface of said belt, comprising:

a cleaning member contacting the non-imaging surface for removal of particles therefrom;

a supporting device for movably supporting said cleaning member in contact with the non-imaging surface;

means for electrically biasing said cleaning member.

3. The apparatus according to claim 1, further comprising:

a sensor for sensing variations in the movement of said belt, and a controller, responsive to said sensor, for generating a signal to adjust said dampening means.

4. The apparatus according to claim 2, wherein the non-imaging surface comprises an image-bearing surface opposed from the non-imaging surface.

5. The apparatus according to claim 2, wherein the non-imaging surface comprises a drive roller adapted for use with an image-bearing belt.

6. The apparatus according to claim 2, wherein said cleaning member includes a brush belt having conductive fibers.

* * * * *